United States Patent [19]

Faulkner

[11] Patent Number: 4,472,841

[45] Date of Patent: Sep. 25, 1984

[54] BATHROOM AIR SANITIZER AND DEODORIZER

[76] Inventor: David L. Faulkner, Rte. 2, Box 54-A, Pevely, Mo. 63070

[21] Appl. No.: 352,113

[22] Filed: Mar. 22, 1982

[51] Int. Cl.[3] ..... E03D 9/05

[52] U.S. Cl. ..... 4/213; 55/279; 55/472

[58] Field of Search ..... 4/209 R, 209 FF, 213, 4/214, 216, 217, 222, 348, 352; 55/234, 279, 467, 472

[56] References Cited

U.S. PATENT DOCUMENTS

| | | | |
|---|---|---|---|
| 2,238,461 | 4/1941 | Carman | 4/213 |
| 2,846,696 | 8/1958 | Herriott | 4/213 |
| 3,370,403 | 2/1968 | D'Elia | 55/472 X |
| 3,705,479 | 12/1972 | McPherson | 55/234 X |
| 3,869,737 | 3/1975 | Stevenson | 4/213 |
| 4,025,325 | 5/1977 | Goodwin | 4/209 FF X |
| 4,099,047 | 7/1978 | Kirkland | 4/213 |
| 4,317,242 | 3/1982 | Stamper | 4/213 |

*Primary Examiner*—Charles E. Phillips

[57] ABSTRACT

A bathroom sanitizer and deodorizer designed to be used with a conventional toilet bowl. A housing means is used, and is so constructed as to have an air intake port at the top and an air exhaust port on the side. A toilet bowl rim clip is attached to the bottom of the air intake port, and an on and off pressure switch is attached to the top of the air intake port. A filtering device consisting of a disinfectant fluid container, a filter frame, and two filters, is placed within the housing means directly behind the air intake port. A filter rotation motor is mounted next to the filter device and is coupled by means of a belt to a pully that is attached to the filter frame. An exhaust fan is mounted within the housing means at the air exhaust port. A combination battery holder and leveler is attached to the bottom exterior of the housing means, and a filler tube is attached to the exterior of the housing means passing thru the lower end of the housing means and attached to the dissinfectant fluid container. Air seals are used within the housing means to insure maximum air flow and to direct the contaminated air directly into the filter device.

1 Claim, 4 Drawing Figures

BATHROOM AIR SANITIZER AND DEODORIZER

SUMMARY

Over the years many devices have been on the market that try to eliminate objectionable odors that are common in all bathrooms. Some of these devices try to exhaust the odors out of the room after they have escaped from the toilet bowl and others try to cover up the objectionable odors with strong perfumed scents. The present invention is designed to withdraw objectionable odors from a toilet bowl before they can enter the bathroom area, sanitizing and deodorizing the contaminated air without leaving any heavy perfumed odors. The device is designed to be installed on the side of any conventional toilet bowl by simply raising the toilet seat, placeing the device over the toilet bowl rim, and lowering the toilet seat to it's original position. The air intake is designed to fit between the toilet bowl and the toilet seat. The on and off switch is in the center of the air intake and is activated when pressure is put on the toilet seat. A filter device is placed within the housing means directly behind the air intake port, consisting of a disinfectant fluid container, a filter frame, and two filters. A filter rotation motor turns the filter frame and filters. An exhaust fan is placed in the exhuast port of the housing means. When the toilet seat is sat upon the on and off switch is turned on and the filter rotation motor and exhaust fan are activated. As the filters are rotated thru the disinfect solution the exhaust fan draws the contaminated air out of the toilet bowl, thru the disinfected filters and discharges the sanitized and deodorized air into the bathroom area.

DETAILED DESCRIPTION

Figure 1:
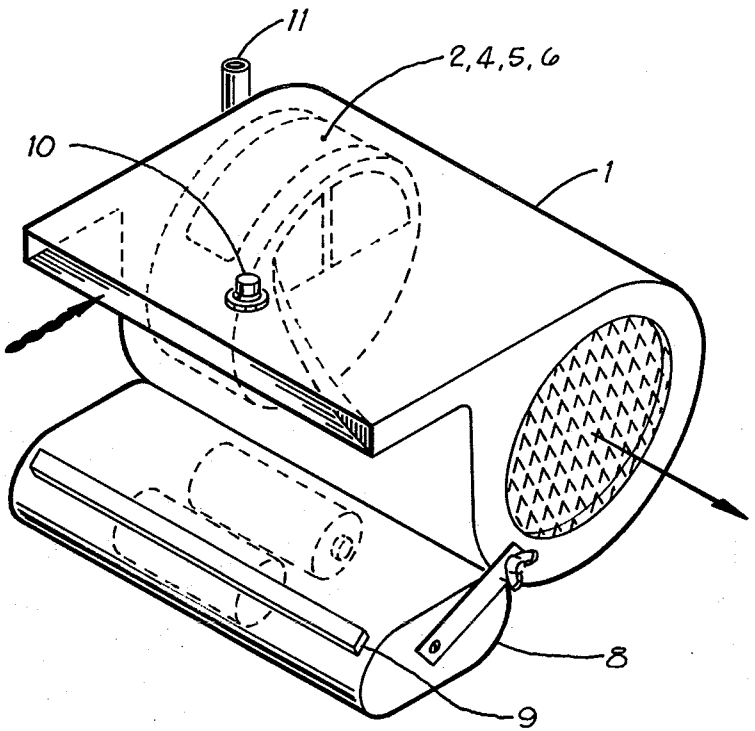
FIG. 1 is a partial perspective view of the bathroom air sanitizer and deodorizer that is described and referred to in the enclosed application for letters patent.
Figure 2:
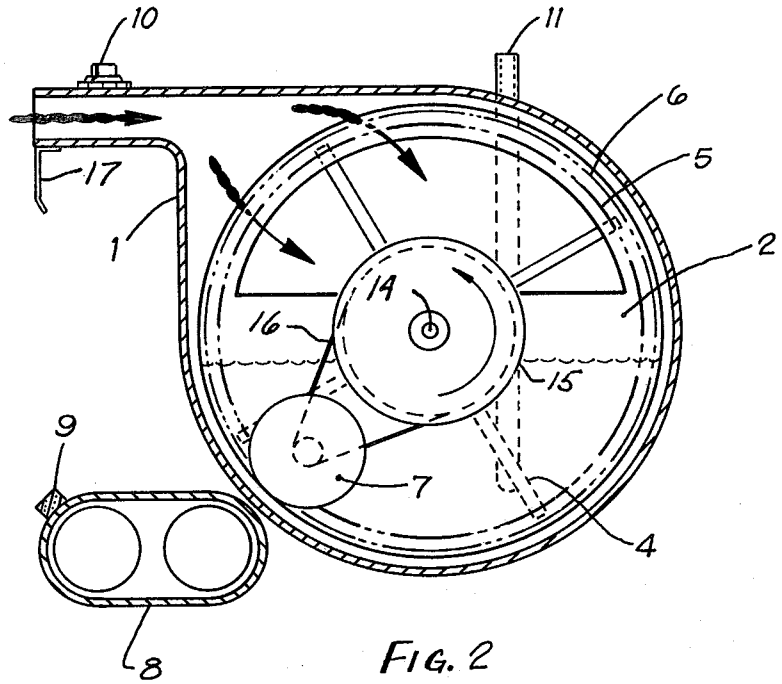
FIG. 2 is a partial elevation view of the bathroom air sanitizer and deodorizer device in FIG. 1.
Figure 3:
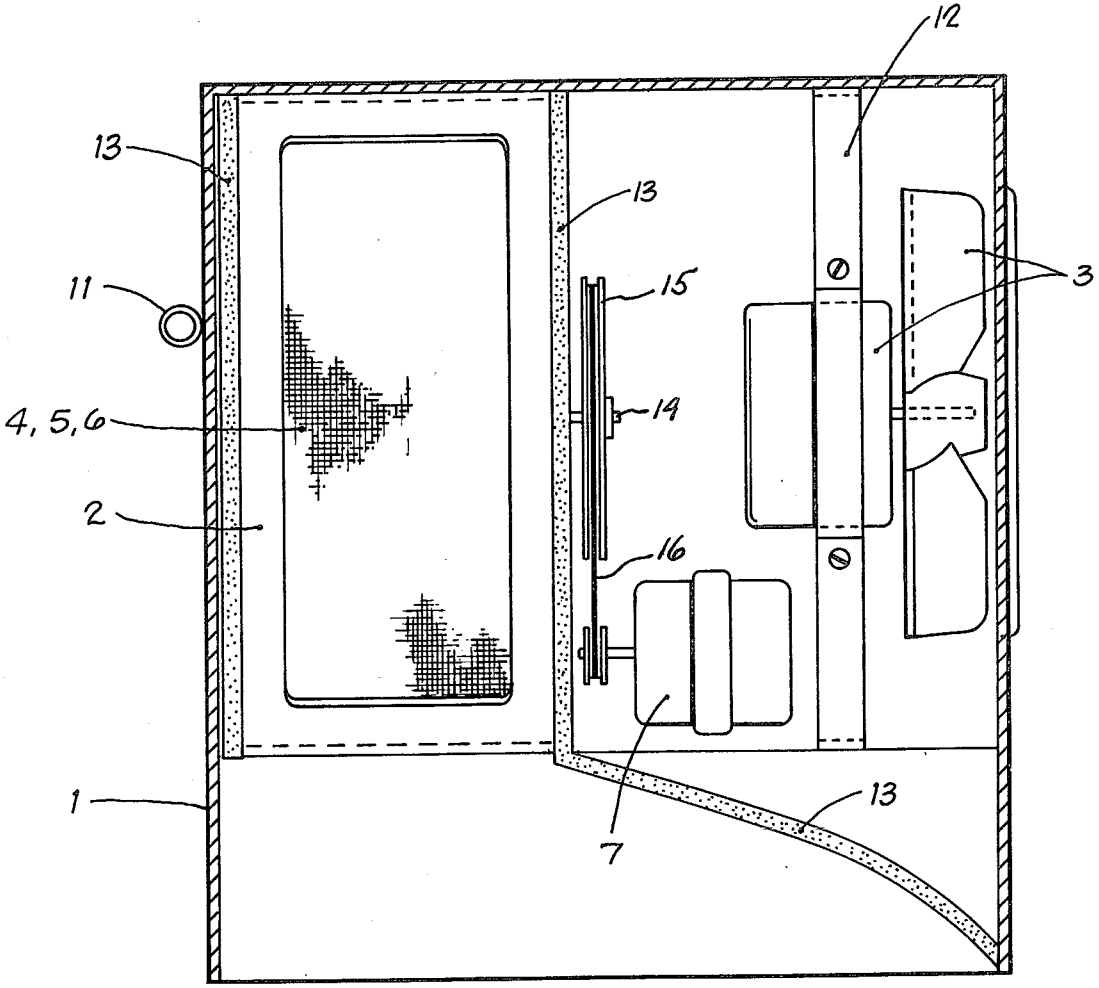
FIG. 3 is a partial plan view of the bathroom air sanitizer and deodorizer device in FIG. 1.
Figure 4:
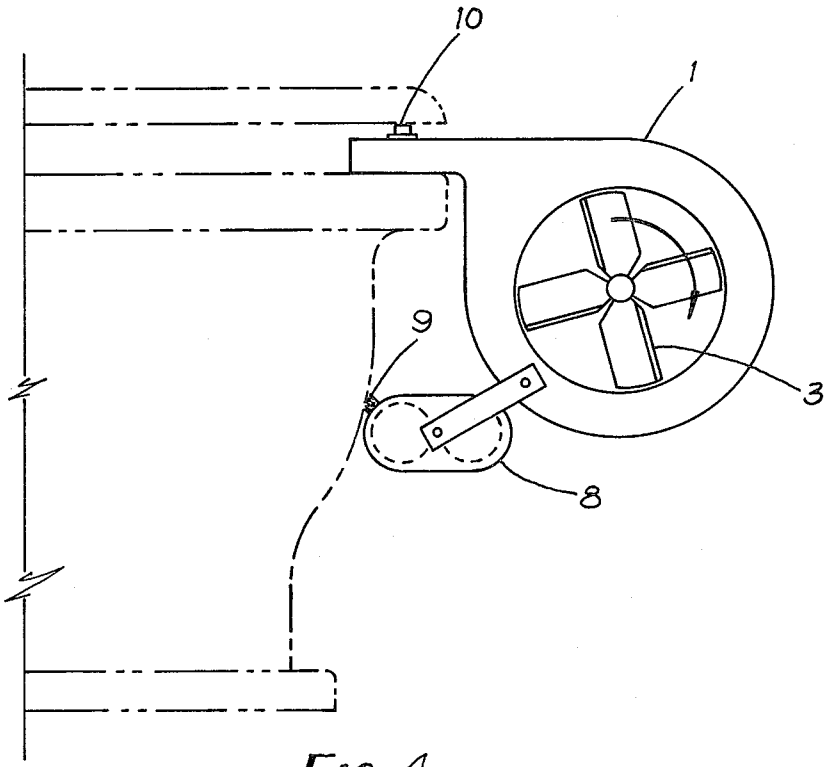
FIG. 4 is a elevation view of the bathroom air sanitizer and deodorizer in FIG. 1, installed.

The filtration and exhaust components of the present invention are enclosed in a housing means 1. The housing means 1, is designed so the top portion of the housing means 1, will clip over the rim of the toilet bowl by means of a rim clip 17, FIG. 2. A battery case and leveler 8, is attached to the lower exterior of the housing means 1. The battery case and leveler 8, serves as a housing means for the power supply as well as being an adjuster to hold the housing means 1, in a level position as shown in FIG. 4. A cushion device 9, is attached to the battery case and leveler 8, to prevent any damage to the side of the toilet bowl. A on and off pressure switch 10, is attached to the housing means 1, where the housing means 1, goes over the toilet bowl rim. The toilet seat rest on top of the on and off switch 10. The on and off switch 10, controls the filter rotation motor 7, and the exhaust fan 3. The air filtering device 2,4,5,6, is placed within the housing means 1, directly behind the on and off switch 10, as shown in FIG. 1. The filtering device consist of a ferriswheel type filter frame 4, with a inside filter 5, and a outside filter 6, attached to the filter frame 4, FIG. 2. The frame 4, with the attached filters 5, and 6, is then placed within the disinfectant fluid container 2, and held in place by an axel 14, that is placed through the center of the disinfectant fluid container 2, and the filter frame 4, FIGS. 2, and 3. A filter rotation motor 7, is placed within the housing means 1, adjacent to the filtering device 2,4,5,6, and is coupled by a belt means 16, to a pully 15, that is attached to the filter frame axel 14, FIGS. 2 and 3. An exhaust fan 3, is placed in the open end of the housing means 1, and is held in place by a fan bracket 12, FIG. 3. Air seals 13, are used within the housing means 1, to direct the contaminated air directly into the filter device 2,4,5,6, FIG. 3. A disinfect filler tube 11, is attached to the outside of the housing means 1, passing through the lower end of the housing means 1, and attached to the disinfectant fluid container 2, FIG. 2.

It should be understood that changes and modifications in the form, construction, arrangement, and combination of the bathroom sanitizer and doedorizer device may be made and substituted for those herein shown and described without departing from the nature and principle of my invention.

Having described my invention, what I claim is new and desire to secure by United States Letters Patent is:

1. An air sanitizer and deodorizer device for use in a toilet bowl having a space between the seat and rim, said device comprising a housing means having an air outlet port and an air intake port comprising a flat horizontally disposed neck portion adapted for lying on said toilet bowl rim between the rim and seat with a vertically disposed clamp for clamping over the inner face of said rim, a switch means mounted within the neck portion of the housing means and extending through the top portion of said neck so as to be activated by the toilet seat, air treatment means mounted within said housing and having a disinfectant fluid housing and a rotating, motor driven, ferris wheel type filter device disposed within said fluid housing, and said filter device being rotated through the disinfectant solution when the device is activated, fan means mounted at the air outlet port of the housing means to draw contaminated air from the toilet bowl through said intake port, through said filter device and out said outlet port, a battery housing horizontally disposed and adjustably pivotally attached to the bottom exterior of said housing means and serving to support said housing means by contacting the outer portion of said bowl in a manner to maintain said intake port in a plane perpendicular to said rim top surface.

* * * * *

UNITED STATES PATENT AND TRADEMARK OFFICE

CERTIFICATE OF CORRECTION

PATENT NO. : 4,472,841

DATED : September 25, 1984

INVENTOR(S) : David L. Faulkner

It is certified that error appears in the above-identified patent and that said Letters Patent is hereby corrected as shown below:

ON THE COVER PAGE, delete patentee's old ADDRESS AND INSERT

834 DELMAR, FESTUS, MO. 63028

Signed and Sealed this

*Fifteenth* Day of *January 1985*

[SEAL]

*Attest:*

*Attesting Officer*

GERALD J. MOSSINGHOFF

*Commissioner of Patents and Trademarks*

UNITED STATES PATENT AND TRADEMARK OFFICE

CERTIFICATE OF CORRECTION

PATENT NO. : 4,472,841

DATED : September 25, 1984

INVENTOR(S) : DAVID L. FAULKNER

It is certified that error appears in the above-identified patent and that said Letters Patent is hereby corrected as shown below:

ON THE COVER PAGE, delete patentee's old address, and insert:

-- 16 Frisco, Festus, Mo. 63028 --

Signed and Sealed this

*Thirtieth* Day of *April 1985*

[SEAL]

*Attest:*

DONALD J. QUIGG

*Attesting Officer*

*Acting Commissioner of Patents and Trademarks*